US008201927B2

(12) United States Patent
Morikoshi et al.

(10) Patent No.: US 8,201,927 B2
(45) Date of Patent: Jun. 19, 2012

(54) FLUID EJECTING APPARATUS AND METHOD FOR PRODUCING THE FLUID EJECTING APPARATUS USING AN ADHESIVE CONTAINING A HYDROPHILIC FUNCTION AGENT

(75) Inventors: Koji Morikoshi, Shiojiri (JP); Takashi Akase, Azumino (JP); Yusuke Hirasawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 363 days.

(21) Appl. No.: 12/412,308

(22) Filed: Mar. 26, 2009

(65) Prior Publication Data

US 2009/0244227 A1 Oct. 1, 2009

(30) Foreign Application Priority Data

Mar. 26, 2008 (JP) ..... 2008-079965

(51) Int. Cl.
*B41J 2/45* (2006.01)
*B41J 2/15* (2006.01)

(52) U.S. Cl. ..... 347/71; 347/20

(58) Field of Classification Search ..... 347/71
See application file for complete search history.

(56) References Cited

U.S. PATENT DOCUMENTS 5,013,383 A * 5/1991 Chapman ..... 347/20
5,650,805 A * 7/1997 Shimomura et al. ..... 347/20
2002/0115744 A1* 8/2002 Svenningsen et al. ..... 523/122
2002/0122095 A1 9/2002 Sanada et al.
2006/0060987 A1* 3/2006 Chen et al. ..... 257/787
2007/0076058 A1* 4/2007 Weaver ..... 347/65

FOREIGN PATENT DOCUMENTS

CN 1301754 C 2/2007
JP 07-232439 A 9/1995
JP 08-325276 A 12/1996
JP 09-039243 A 2/1997
JP 10044443 A * 2/1998
JP 2003-154658 A 5/2003
WO WO 02/070026 A1 9/2002

OTHER PUBLICATIONS

Machine generated English translation of Japanese patent document JP 09-039243, "Laminated Ink Jet Type Recording Head, Manufacture Thereof and Recorder" to Yamamoto et al.; 11 pgs. translation obtained via http://www.ipdl.inpit.go.jp/homepg_e.ipdl on Jun. 29, 2011.*

* cited by examiner

*Primary Examiner* — Shelby Fidler
(74) *Attorney, Agent, or Firm* — Kilpatrick Townsend & Stockton LLP

(57) ABSTRACT

A fluid ejecting apparatus, contains: an ejecting head having a plurality of nozzles for ejecting a fluid and having a laminated structure in which a flow passage plate, in which a passage for the fluid is formed, is provided via an adhesive, in which the adhesive contains an adhesion resin, to which a hydrophilic function agent that gives hydrophilicity to the adhesive is added in a proportion of from 0.25 wt % to 5.0 wt %.

8 Claims, 5 Drawing Sheets

FIG. 3

| HYDROPHILICITY EVALUATION RESULTS | ADDITIVE (1) | | ADDITIVE (2) | |
|---|---|---|---|---|
| | INITIAL | AFTER INK DEPOSITION | INITIAL | AFTER INK DEPOSITION |
| NO ADDITION | × (100 OR MORE) | × | × | × |
| ADDITION AMOUNT 0.1 (wt%) | △(90 TO 100) | — | — | — |
| 0.25 (wt%) | △ (75 TO 85) | △ (75 TO 90) | — | — |
| 0.5 (wt%) | ○ (75 TO 80) | △ (75 TO 85) | — | — |
| 1.0 (wt%) | ○ (75 TO 80) | ○ (70 TO 80) | — | — |
| 2.0 (wt%) | ○ (75 TO 80) | ○ (65 TO 80) | ○ (65 TO 75) | ○ (65 TO 75) |
| 5.0 (wt%) | ○ (75 TO 80) | ○ (65 TO 75) | — | — |
| 10 (wt%) | — | — | ○ (70 TO 75) | ○ (70 TO 75) |

○ : CONTACT ANGLE OF 80° OR LOWER (NO ADSORPTION OF BUBBLES)

△ : CONTACT ANGLE OF 80° TO 100° (PARTIAL ADSORPTION OF BUBBLES)

× : CONTACT ANGLE OF 100° OR MORE (ADSORPTION OF BUBBLES)

FIG. 4

| HYDROPHILICITY EVALUATION RESULTS | ADDITIVE (1) | | ADDITIVE (2) | |
|---|---|---|---|---|
| | INITIAL | AFTER INK DEPOSITION | INITIAL | AFTER INK DEPOSITION |
| NO ADDITION | × (40) | × | × | × |
| ADDITION AMOUNT 0.1 (wt%) | — | — | — | — |
| 0.25 (wt%) | ○ (30 TO 25) | △ TO × | — | — |
| 0.5 (wt%) | — | — | — | — |
| 1.0 (wt%) | ○ (15 TO 20) | ○ | — | — |
| 2.0 (wt%) | ○ (2 TO 5) | ○ | ○ (5 TO 10) | ○ |
| 5.0 (wt%) | ○ (LOWER THAN 2) | ○ | — | — |
| 10 (wt%) | — | — | ○ (LOWER THAN 2) | ○ |

○ : CONTACT ANGLE OF 30° OR LOWER (NO ADSORPTION OF BUBBLES)

△ : CONTACT ANGLE OF 30° TO 40° (PARTIAL ADSORPTION OF BUBBLES)

× : CONTACT ANGLE OF 40° OR MORE (ADSORPTION OF BUBBLES)

FIG. 5

| ADHESION WITH SUS | ADDITIVE (1) | | ADDITIVE (2) | |
|---|---|---|---|---|
| | INITIAL | AFTER INK DEPOSITION | INITIAL | AFTER INK DEPOSITION |
| NO ADDITION | ○ | ○ | ○ | ○ |
| ADDITION AMOUNT 0.1 (wt% ) | ○ | — | — | — |
| 0.25 (wt% ) | ○ | ○ | — | — |
| 0.5 (wt% ) | ○ | ○ | — | — |
| 1.0 (wt% ) | ○ | ○ | ○ | ○ |
| 2.0 (wt% ) | ○ | ○ | △ | △ |
| 5.0 (wt% ) | ○ | △ | △ | △ |
| 10 (wt% ) | △ | × | △ | × |

○ : CONTACT ANGLE OF 80° OR LOWER (NO ADSORPTION OF BUBBLES)

△ : CONTACT ANGLE OF 80° TO 100° (PARTIAL ADSORPTION OF BUBBLES)

× : CONTACT ANGLE OF 100° OR MORE (ADSORPTION OF BUBBLES)

FLUID EJECTING APPARATUS AND METHOD FOR PRODUCING THE FLUID EJECTING APPARATUS USING AN ADHESIVE CONTAINING A HYDROPHILIC FUNCTION AGENT

The entire disclosure of Japanese Patent Application No. 2008-079965, filed Mar. 26, 2008 is expressly incorporated by reference herein.

BACKGROUND

1. Technical Field

The present invention relates to a fluid ejecting apparatus and a method for producing the fluid ejecting apparatus.

2. Related Art

Fluid ejecting apparatuses have ejecting heads capable of ejecting a liquid (fluid) in the form of liquid droplets and eject various kinds of liquids from the ejecting heads. For example, as a typical fluid ejecting apparatus, image recording devices, such as an ink jet printer that has an ink jet recording head as a fluid ejecting head (hereinafter simply referred to as a recording head) and that performs recording by discharging and depositing a liquid ink from a nozzle opening of the recoding head (ejecting head) in the form of an ink droplet to an ejection target, such as a recording sheet, to form dots can be mentioned (e.g., JP-A-9-39243).

In the recording head disclosed in JP-A-9-39243, a flow passage forming substrate in which a flow passage is formed and a nozzle plate through which nozzle openings are formed are laminated to each other with an adhesive. Therefore, the adhesive is exposed or partially overflows into a laminated area in the flow passage. In general, adhesives have low hydrophilicity to inks and adsorption of bubbles is likely to occur in a portion where the adhesive is exposed in the flow passage, which may easily cause poor printing. Then, hydrophilic adhesives, such as acryl or nylon, may be used. However, in such a case, it becomes difficult to obtain sufficient adhesion properties. Or, hydrophilic inks may be used. However, in such a case, usable inks are limited, which may narrow the degree of freedom of design.

SUMMARY

An advantage of some aspects of the invention is that it provides a fluid ejecting apparatus in which adsorption of bubbles in a flow passage having a laminated structure by an adhesive has been suppressed and a method for producing the fluid ejecting apparatus.

In order to solve the above-described problems, the fluid ejecting apparatus according to a first aspect of the invention has an ejecting head having a plurality of nozzles for ejecting a fluid and having a flow passage for the fluid having a laminated structure with an adhesive, in which the adhesive contains an adhesion resin, to which a hydrophilic function agent that gives hydrophilicity to the fluid is added in a proportion of from 0.25 wt % to 5.0 wt %.

In accordance with the fluid ejecting apparatus according to the first aspect of the invention, since the adhesion resin, to which the hydrophilic function agent is added in a given proportion, is contained, the hydrophilicity to the fluid in the adhesive forming the laminated structure of the head increases as shown in experimental results shown later. Therefore, the development of adsorption of bubbles can be made difficult in the adhesive exposed in the flow passage. Since the adsorption of bubbles is hard to occur even when the adhesive overflows into the flow passage, the control of the amount of the adhesive that has overflowed can be simplified. Furthermore, the degree of freedom of design of a usable fluid can be increased.

In the fluid ejecting apparatus according to a second aspect of the invention, it is preferable that the hydrophilic function agent be added to the adhesion resin in a proportion of from 0.5 wt % to 5.0 wt % in the adhesive. In the fluid ejecting apparatus according to a third aspect of the invention, it is more preferable that the hydrophilic function agent be added to the adhesion resin in a proportion of 1.0 wt % in the adhesive, and it is most preferable that the hydrophilic function agent be added to the adhesion resin in a proportion of 1.0 wt % in the adhesive. Thus, an adhesive imparted with the above-described hydrophilicity and also sufficient bonding strength can be obtained. The "wt %" as used herein represents "% by weight".

In the fluid ejecting apparatus according to a fourth aspect of the invention, it is preferable that the hydrophilic function agent contain a surfactant, an antistatic agent, or an antifogger. According to the structure, hydrophilicity to a fluid can be favorably imparted to adhesives.

It is preferable that the surfactant contain a nonionic surfactant or an anionic surfactant in the fluid ejecting apparatus according to a fifth aspect of the invention.

With the structure, when an ink is used as the fluid, the fluid ejecting apparatus is difficult to be influenced by ionic contents in the ink and the development of foreign substances in the head due to reaction with the ink can be prevented. Accordingly, the invention can be applied to ink jet devices.

In the fluid ejecting apparatus according to a sixth aspect of the invention, it is preferable that the fluid ejected from the nozzle be a water-based dye ink or a water-based pigment ink.

With the structure, a dye ink or a pigment ink can be ejected from the ejecting head, whereby the invention becomes particularly suitable for ink jet devices.

A method for producing a fluid ejecting apparatus according to a seventh aspect of the invention, including: in a method for producing a fluid ejecting apparatus having an ejecting head having a plurality of nozzles for ejecting a fluid and having a flow passage for the fluid having a laminated structure via an adhesive, forming the laminated structure by laminating component members of the ejecting head to each other via an adhesion resin, to which a hydrophilic function agent that imparts hydrophilicity to the fluid is added in a proportion of from 0.25 wt % to 5.0 wt %.

In accordance with the method for producing a fluid ejecting apparatus according to the seventh aspect of the invention, the adhesive contains an adhesion resin, to which the hydrophilic agent is added in a given proportion as shown in experimental results shown later, and thus the hydrophilicity to the fluid increases. Accordingly, the development of adsorption of bubbles in the adhesive exposed in the flow passage can be made difficult. The invention also can provide a fluid ejecting apparatus in which, since the adsorption of bubbles is hard to occur even when the adhesive overflows into the flow passage, the control of the amount of the adhesive that has overflowed can be simplified and the degree of freedom of design of a usable fluid can be increased.

In the method for producing a fluid ejecting apparatus according to an eighth aspect of the invention, it is preferable that the adhesion resin be thermally melted during the lamination during the lamination.

With the structure, the hydrophilic function agent contained in the adhesion resin bleeds to the surface when the adhesion resin is thermally melted, thereby increasing a degree of hydrophilicity of the surface of the adhesive due to a hydrophilic functional group in the hydrophilic function agent.

BRIEF DESCRIPTION OF THE DRAWINGS

The invention will be described with reference to the accompanying drawings, wherein like numbers reference like elements.

FIG. 3 is a view illustrating results of measuring a static contact angle to pure water in an adhesive.

FIG. 4 is a view illustrating results of measuring a static contact angle to an ink in an adhesive.

FIG. 5 is a view illustrating results of determining a relationship between the addition amount of an additive and adhesion properties.

DESCRIPTION OF EXEMPLARY EMBODIMENTS

Figure 1:
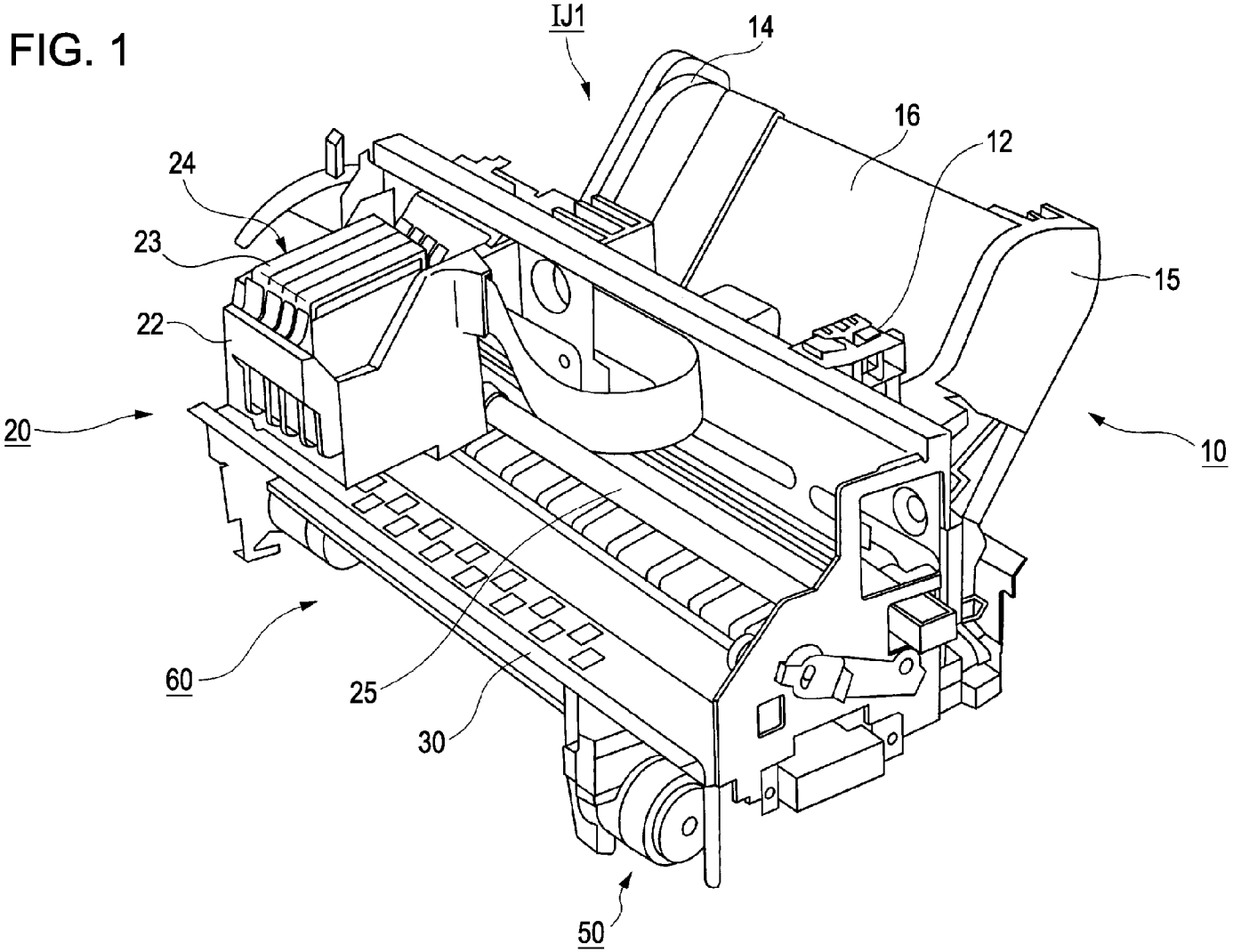
FIG. 1 is a perspective view illustrating an outline of the internal structure of an ink jet printer.

Hereinafter, a fluid ejecting apparatus according to an embodiment of the invention will be described with reference to the drawings. The scale of each member is suitably changed in order to have a recognizable size in the drawings described below. The fluid ejecting apparatus according to this embodiment is an apparatus that ejects a fluid, such as an ink. The description will be given taking, as an example, an ink jet printer that performs recording on a recording medium by ejecting an ink onto the recording medium from ejection openings of a recording head. As an example of the ink jet recording device, an ink jet printer (hereinafter referred to as a printer) that performs recording on a recording sheet as a recording medium by discharging (ejecting) ink droplets onto the recording sheet will be described.

FIG. 1 is a perspective view illustrating an outline of the internal structure of the printer.

As shown in FIG. 1, a printer IJ1 has a paper feeding unit 10 that feeds a print sheet P, a carriage unit 20 having a recording head 24 and a carriage 22, a transporting unit 60 that transports the print sheet P, and an ink system unit 50 that performs maintenance of a recording head 24.

A carriage unit 20 and an ink system unit 50 are connected to the upper side and the side, respectively, of the transporting unit 60 and the paper feeding unit 10 is connected to the back of the carriage unit 20, whereby the four units are combined.

Figure 2:
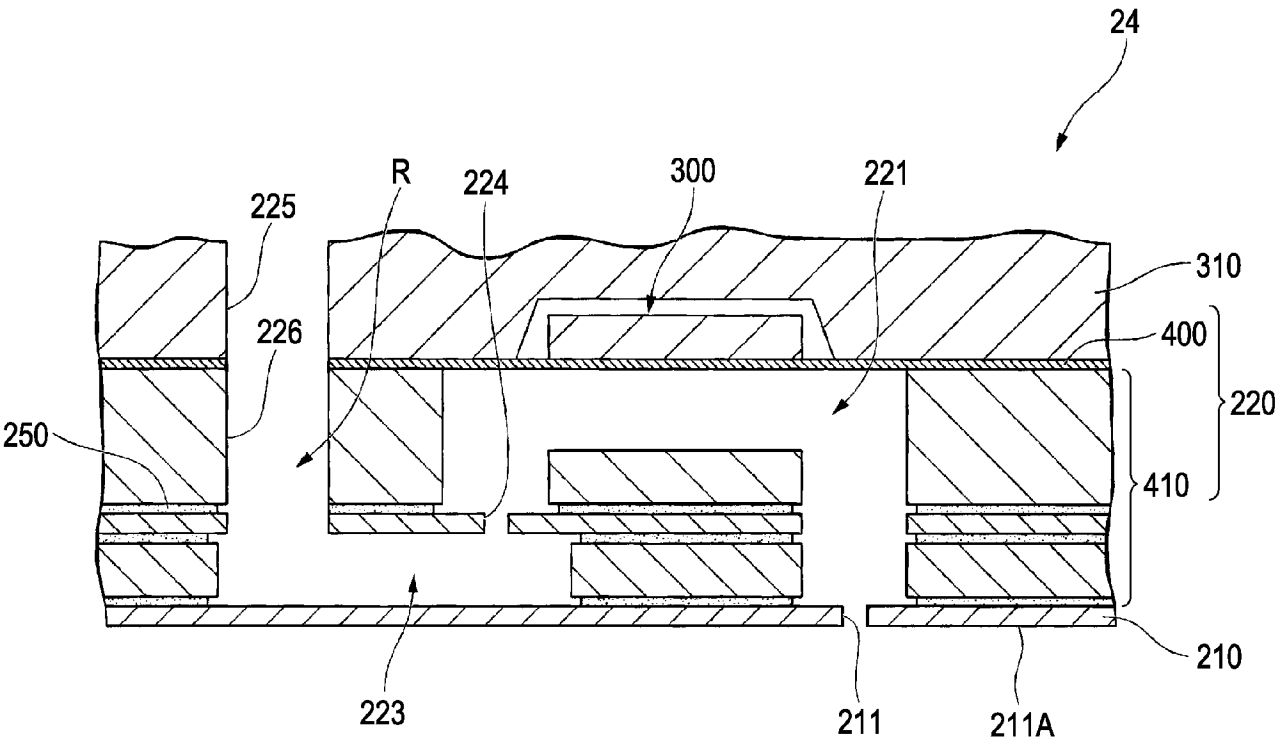
FIG. 2 is a cross section illustrating the outline structure of a recording head.

As shown in FIG. 2, the recording head 24 is a member that ejects an ink from a nozzle 211 while forming the ink into liquid droplets. As shown in FIG. 2, the recording head 24 has a flow passage forming substrate 220 forming a pressure generating chamber 221 that communicates with the nozzle 211 from which an ink is discharged, a piezoelectric element 300 that is located on the upper surface of the pressure generating chamber 221 and changes the pressure in the pressure generating chamber 221, and a casing 310 that covers the piezoelectric element 300 and is formed of SUS (stainless steel).

The flow passage forming substrate 220 contains a substrate body 410 and a diaphragm 400 laminated onto the substrate body 410. The substrate body 410 is obtained by laminating plate-shaped members formed of SUS to each other with an adhesive 250. To the undersurface of the flow passage forming substrate 220 (side opposite to the piezoelectric element 300), a nozzle substrate 210, which has a nozzle formation side 211A through which a plurality of nozzles 211 are formed and is formed of SUS, is laminated using the adhesive 250. More specifically, the recording head 24 can be produced by laminating the respective members by hot welding using the adhesive 250.

The adhesive 250 is a hot welding film adhesive into which an adhesion resin, to which an additive (hydrophilic function agent) that gives hydrophilicity to an ink has been added, is kneaded. The additive is added to the adhesion resin in a proportion of from 0.25 wt % to 5.0 wt %. The proportion of the additive in the adhesive 250 is more preferably from 0.5 wt % to 5.0 wt % and most preferably 1.0 wt % as shown in experimental results shown later.

As the adhesion resin, a thermoplastic resin is used. Specifically, a polyolefin resin (polypropylene, polyethylene, or EVA base) having excellent properties of adhesion between metals (e.g., ADMER VE 300 manufactured by Mitsui Chemicals, Inc.) was used.

The following substances may be used as the adhesion resin. For example, polyolefin resins, such as polypropylene, polybutene, polymethylpentene, polystyrene, polyester, polyamide, and polyethylene, can be used. In addition, ethylene polymers, such as an ethylene·α-olefin copolymer, an ethylene·vinylacetate copolymer (EVA), an ethylene·(meth) acrylic acid copolymer, and an ethylene·(meth)acrylic acid ester copolymer are usable as the adhesion resin.

The additive contains a surfactant, an antistatic agent, or an antifogger. In particular, as an ink jet additive, it is preferable to use a nonionic surfactant or an anionic surfactant. This is because such surfactants are negligibly influenced by ionic contents in the ink and do not generate foreign substances or the like in the head (inside of an ink flow passage) due to reaction with the ink.

Examples of the nonionic surfactant include polyoxyethylene alkyl ether, polyoxyethylene alkylamine, glycerol fatty acid ester, polyglycerol fatty acid ester, polyoxyethylene alkylamide, sorbitan, propylene glycol, polypropylene glycol, fatty acid sorbitan ester, and alkyl monoglyceryl ether.

Examples of the anionic surfactant include alkylsulfonates and alkylbenzenesulfonates.

Specifically, in this embodiment, the adhesive 250 contains, as the additive, IRUGASURFHL560 (equivalent to additive (1) in experimental examples described later) manufactured by Chiba Speciality Chemicals K.K. containing, as a main component, a mix masterbatch of polyoxyethylene alkylether and polypropylene, for example, or ATMER129V (equivalent to additive (2) in experimental examples described later) manufactured by Chiba Speciality Chemicals K.K. containing, as a main component, glycerol fatty acid ester, for example.

The adhesive 250 is subjected to thermofusion in laminating. Therefore, the above-mentioned additive contained in the adhesion resin bleeds (blur) to the surface, and the degree of hydrophilicity of the surface of the adhesive 250 can be increased by the hydrophilic functional group in the additive that has bled.

In the recording head 24, SUS (stainless steel) is used for component members (substrate body 410, casing 310, and nozzle substrate 210) thereof. Here, the static contact angle to the component members in an ink is adjusted to 30° or lower. The static contact angle to the adhesive 250 in an ink is adjusted to 30° or lower as shown in experimental results described later.

Thus, the hydrophilicity to an ink in the adhesive 250 increases due to the additive contained in a given proportion as described above, whereby the adhesive 250 is imparted with hydrophilicity equivalent to that of the component member of the recording head 24. In the printer 1 according to this embodiment, either a water-based dye ink or a water-based pigment ink can be used as the above-mentioned ink.

The nozzles 211 are formed through the nozzle substrate 210 at positions corresponding to respective pressure generating chambers 221 when the nozzle substrate 210 is laminated to the flow passage forming substrate 220. The respective pressure generating chambers 221 are separated by side walls (not shown) and are connected to a reservoir 223, which is a common flow passage, through a supply port 224. An ink introduction port 225 for supplying an ink to the reservoir 223 is formed through the casing 310. An introduction passage 226 for communication between the ink introduction port 225 and the reservoir 223 is formed through the flow passage forming substrate 220. The ink introduction port 225 is provided in such a manner as to correspond to at least the number of inks (four in this embodiment) that are supplied from an ink cartridge 23.

Thus, the wall surface of a flow passage R in the recording head 24 has a laminated structure with the adhesive 250. Thus, when surface sink or overflow of the adhesive 250 occurs into the adhesion part of each member, irregularities are formed on the passage wall surface. Here, the flow passage R corresponds to an area through which the ink introduced in the recording head 24 through the ink introduction port 225 reaches the nozzle 211.

In the recording head having a laminated structure with an adhesive that does not contain an additive in a given proportion as mentioned above, the adhesive exposed in the passage wall surface does not have hydrophilicity to an ink. Therefore, in the recording head, bubbles that are generated in and enter the flow passage are likely to be adsorbed, which hinders easy discharging of the bubbles even when maintenance, such as cleaning for discharging the ink from the nozzle 211 by sucking, is performed.

In contrast, in the recording head 24 according to this embodiment, the flow passage R is formed by the laminated structure with the adhesive 250, to which hydrophilicity to an ink has been imparted as described above. Therefore, the ink can smoothly flow through the flow passage R.

Thus, the adsorption of bubbles is suppressed even when the surface sink or overflow of the adhesive occurs into the flow passage R. Even when the adsorption of bubbles occurs in the flow passage R, the bubbles can be easily discharged to the outside by sucking as described above, and thus poor ink ejection resulting from staying of the bubbles in the flow passage R can be prevented.

Even when the adhesive 250 has overflowed into the flow passage R for an ink, it is difficult for the adsorption of bubbles to occur as described above. Therefore, the overflow amount of the adhesive does not need to be strictly controlled. Moreover, the adhesive 250 itself that is exposed in the flow passage R has hydrophilicity to an ink, which eliminates the necessity of using a special ink, such as a hydrophilic ink. Therefore, narrowing of the degree of freedom of design of a usable ink is prevented.

Experimental Results

Here, the experimental results showing the effects of the adhesive (equivalent to the adhesive 250) that forms the laminated structure in the recording head of the printer according to preferred embodiments of the invention will be described.

FIG. 3 is a table showing the results of measuring the static contact angle to pure water in an adhesive. FIG. 4 is a table showing the results of measuring the static contact angle to an ink in an adhesive. FIG. 5 is a table showing the results of determining a relationship between the addition amount of an additive and the adhesion properties in an adhesive. In FIGS. 3 and 4, the static contact angle refers to an angle to pure water or an ink (water-based dye ink) in the passage wall surface. In each figure, the kind of the additives to be blended in the adhesives was changed as follows: polyoxyethylene alkylether in Example 1; and glycerol fatty acid ester in Example 2. As the adhesion resin, a polyolefin resin (polypropylene, polyethylene, or EVA base) was used. In each table of each figure, the results shown in the column of "initial" refer to the results of measuring the contact angle immediately after the formation of the laminated structure of the recording head via an adhesive and the results shown in the column of "after ink deposition" refer to the results of measuring the contact angle after an acceleration test in which the adhesive was immersed in the ink at 60° C. for 2 months.

As shown in FIG. 3, it was confirmed that the hydrophilicity to pure water increased in both additives 1 and 2 when the addition amounts thereof were in the range of from 0.25 wt % to 10 wt %. The static contact angle of pure water to SUS (stainless steel) used as the component members of the head is from 70° to 80° as in the above-described embodiments. Therefore, it can be confirmed that the static contact angle to the adhesive becomes approximately equal to the contact angle to SUS by introducing the additives 1 and 2.

As shown in FIG. 4, it was confirmed that the hydrophilicity to an ink (water-based dye ink) increases in both the additive 1 and 2. Here, the static contact angle of an ink to SUS (stainless steel) used as the component members of the head is 30°. Accordingly, it can be confirmed that the contact angle to the adhesive becomes approximately equal to the static contact angle to SUS by introducing the additives 1 and 2.

As shown in FIG. 5, when the amount of the additive contained in the adhesive is excessively large, the adhesion properties to SUS (stainless steel) used as the component members of the head decrease. The adhesion properties were evaluated based on the existence of occurrence of interfacial separation in the adhesive. The case where the interfacial separation occurs was evaluated that the strength of the adhesive is insufficient based on a possibility that an ink may leak from the interface between the head component member and the adhesive. Accordingly, the development of interfacial separation was confirmed in both the additives 1 and 2 when the addition amount reached 10 wt %.

More specifically, as is understood from the experimental results shown in FIGS. 3 to 5, when the adhesion contains the additive in a proportion of from 0.25 wt % to 5.0 wt %, sufficient adhesion strength can be obtained and also hydrophilicity to an ink is imparted. The addition amount of the additive is more preferably from 0.5 wt % to 5.0 wt %, with 1.0 wt % being the most preferable.

The invention is not limited to the above-described embodiments, and various changes can be made without departing from the gist of the invention. For example, in the experiments above, a water-based dye ink was used, but the same tendency can be obtained also in a water-based pigment ink by using a head having a laminated structure with an adhesive, to which an additive is added in the above-mentioned proportion.

What is claimed is:

1. A fluid ejecting apparatus, comprising:

an ejecting head comprising:

a plurality of nozzles for ejecting a fluid; and a laminated structure comprising a flow passage plate comprising a passage for the fluid, and an adhesive, the adhesive comprising an adhesion resin comprising a hydrophilic function agent that gives hydrophilicity to the adhesive, the hydrophilic function agent being present in a proportion of from 0.25 wt % to 5.0 wt % of the adhesion resin.

2. The fluid ejecting apparatus according to claim 1, wherein the hydrophilic function agent is present in a proportion of from 0.5 wt % to 5.0 wt % of the adhesion resin.

3. The fluid ejecting apparatus according to claim 2, wherein the hydrophilic function agent present in a proportion of 1.0 wt % of the adhesion resin.

4. The fluid ejecting apparatus according to claim 1, wherein the hydrophilic function agent comprises a surfactant, an antistatic agent, or an antifogger.

5. The fluid ejecting apparatus according to claim 4, wherein the surfactant comprises a nonionic surfactant or an anionic surfactant.

6. The fluid ejecting apparatus according to claim 1, wherein the fluid ejected from the nozzles is a water-based dye ink or a water-based pigment ink.

7. A method for producing a fluid ejecting apparatus comprising an ejecting head comprising a plurality of nozzles for ejecting a fluid, the method comprising:

providing component members of the ejecting head, the component members comprising a flow passage plate comprising a passage for the fluid; and forming a laminated structure of the ejecting head by laminating the component members via an adhesion resin, comprising a hydrophilic function agent that imparts hydrophilicity to the adhesive, the hydrophilic function agent being present in a proportion of from 0.25 wt % to 5.0 wt % of the adhesion resin.

8. The method for producing a fluid ejecting apparatus according to claim 7, comprising thermally melting the adhesion resin during the lamination.

* * * * *